US007779629B2

(12) United States Patent
Isono et al.

(10) Patent No.: US 7,779,629 B2
(45) Date of Patent: Aug. 24, 2010

(54) PRESSURE ACCUMULATING APPARATUS

(75) Inventors: Hiroshi Isono, Mishima (JP); Yasuji Mizutani, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 434 days.

(21) Appl. No.: 11/908,414

(22) PCT Filed: Mar. 24, 2006

(86) PCT No.: PCT/JP2006/306766

§ 371 (c)(1),
(2), (4) Date: Sep. 12, 2007

(87) PCT Pub. No.: WO2006/106891

PCT Pub. Date: Oct. 12, 2006

(65) Prior Publication Data

US 2009/0007979 A1 Jan. 8, 2009

(30) Foreign Application Priority Data

Apr. 1, 2005 (JP) ..... 2005-105656

(51) Int. Cl.
*F04B 49/12* (2006.01)
*F04B 41/02* (2006.01)

(52) U.S. Cl. ..... 60/413; 60/414

(58) Field of Classification Search ..... 60/413, 60/414; 92/33, 61; 417/214, 540, 544
See application file for complete search history.

(56) References Cited

U.S. PATENT DOCUMENTS 3,425,288 A 2/1969 Golden et al.
4,515,530 A * 5/1985 Christoleit ..... 417/214
4,632,639 A 12/1986 Beaumont
4,655,693 A 4/1987 Grime
5,558,730 A 9/1996 Olney et al.
6,892,776 B2 5/2005 Skoff
2005/0194087 A1 9/2005 Ogawa

FOREIGN PATENT DOCUMENTS

CH 228739 9/1943
EP 0 344 004 A2 11/1989

(Continued)

*Primary Examiner*—Thomas E Lazo
(74) *Attorney, Agent, or Firm*—Oblon, Spivak, McClelland, Maier & Neustadt, L.L.P.

(57) ABSTRACT

Rotational force from a driving device 11 is transmitted to an eccentric cam 32 through a rotating rod 31, and the eccentric cam 32 causes a piston 22 and a piston rod 25 to move up and down in a reciprocating manner by its rotation. Atmospheric air is inspired into a first chamber R1 in a cylinder 21 upon the descent of the piston 22. Upon the rise of the piston 22, the air in the first chamber R1 is compressed, and the compressed high-pressure air is discharged to an accumulator 12 through a discharge valve 25. The accumulator communicates with a second chamber R2 in the cylinder 21. When the air pressure in the accumulator 12 increases, this high-pressure air pushes the piston 22 to cancel the contact between the piston rod 26 and the eccentric cam 32, whereby the power transmission from a power transmission device 30 to a pressure conversion mechanism 20 is cut off.

3 Claims, 10 Drawing Sheets

FOREIGN PATENT DOCUMENTS

| | | |
|---|---|---|
| EP | 1 394 415 | 3/2004 |
| JP | 59-96489 | 6/1984 |
| JP | 4-129809 | 4/1992 |
| JP | 9 508870 | 9/1997 |
| JP | 9 286312 | 11/1997 |
| JP | 10 167089 | 6/1998 |
| JP | 2004-17962 | 1/2004 |
| JP | 2005 247035 | 9/2005 |
| WO | WO 03/011617 | 2/2003 |

* cited by examiner

PRESSURE ACCUMULATING APPARATUS

TECHNICAL FIELD

The present invention relates to a pressure accumulating apparatus that makes a conversion of fluid pressure by using power from a power source and accumulates the converted fluid pressure.

BACKGROUND ART

There has conventionally been known a pressure accumulating apparatus in which hydraulic pressure generated by a pump (fluid pressure conversion means) driven by a vehicle engine (power source) is accumulated in an accumulator (accumulating means) and the accumulated hydraulic pressure is utilized. It has been known that, in this type of the pressure accumulating apparatus, when the hydraulic pressure accumulated in the accumulator is not more than a predetermined pressure, high-pressure hydraulic fluid discharged from the pump is supplied to the accumulator, while when the hydraulic pressure accumulated in the accumulator exceeds the predetermined pressure, the escape of the hydraulic fluid discharged from the pump to a reservoir through a relief valve is allowed for reducing a load of the pump. (Japanese Unexamined Patent Application No. 9 (1998)-286321)

However, in the aforesaid conventional apparatus, although the load of the pump is relieved when the hydraulic pressure accumulated in the accumulator exceeds the predetermined pressure, the pump is kept driven by the vehicle engine. Accordingly, the components in the pump (e.g., piston) are kept operated. Therefore, this provides insufficient relief in the load, and further, adversely affects the durability of the components in the pump.

DISCLOSURE OF INVENTION

The present invention is accomplished in view of the above-mentioned problem, and aims to provide a pressure accumulating apparatus that eliminates useless action of pressure conversion means to reduce power loss as much as possible, and enhances durability of the pressure conversion means.

In order to accomplish the foregoing object, the feature of the invention is a pressure accumulating apparatus comprising a power source that generates power; pressure conversion means that makes a conversion of a fluid pressure by using the power transmitted from the power source; power transmission means that transmits power from the power source to the pressure conversion means; and pressure accumulating means that accumulates the fluid pressure converted by the pressure conversion means, this pressure accumulating apparatus further comprising restricting means that restricts the output of the fluid pressure from the pressure conversion means to the pressure accumulating means by changing the power transmission state from the power source to the pressure conversion means with the control of the power transmission means by using the fluid pressure accumulated in the accumulating means.

In this case, the pressure conversion means is for converting the fluid pressure into high pressure, and the pressure accumulating means accumulates high fluid pressure, for example. On the contrary, the pressure conversion means may convert the fluid pressure into low pressure, and in this case, the pressure accumulating means accumulates low fluid pressure.

In the feature of the present invention thus configured, the power transmission means is controlled by the restricting means with the use of the fluid pressure accumulated in the pressure accumulating means, and the output of the fluid pressure from the pressure conversion means to the pressure accumulating means is restricted by changing the power transmission state from the power source to the pressure conversion means. As a result, when the pressure conversion operation at the pressure conversion means is unnecessary, the operation of the pressure conversion means is restricted, whereby the power loss of the power source can be restrained, and further, the durability of the pressure conversion means is enhanced.

Specifically, the pressure conversion means is composed of, for example, a cylinder, a piston that is accommodated in the cylinder in an airtight or liquid-tight and slidable manner for dividing the inside of the cylinder into a first chamber and a second chamber, a piston rod that is connected to the piston at the side of the second chamber for causing the piston to move in the axial direction in the cylinder in a reciprocating manner by the reciprocating movement thereof in the axial direction, an intake valve that is connected to the first chamber for inspiring a low-pressure fluid into the first chamber upon the displacement of the piston toward the second chamber, and a discharge valve that is connected to the first chamber for discharging the high-pressure fluid in the first chamber upon the displacement of the piston toward the first chamber, wherein the power transmission means is configured to cause the piston rod to move in a reciprocating manner in the axial direction within a predetermined range in accordance with the power from the power source, and the restricting means is configured to direct the high-pressure fluid at the downstream side of the discharge valve into the second chamber, and to urge the piston toward the first chamber of the cylinder when the fluid pressure at the downstream side of the discharge valve becomes higher than the fluid pressure at the upstream side of the intake valve by a predetermined pressure. In this case, the power source may be configured to generate rotational force, and the power transmission means may be composed of a cam that rotates in accordance with the rotational force from the power source and converts the rotation into the reciprocating movement of the piston rod in the axial direction.

With this configuration, the piston in the pressure conversion means makes a reciprocating movement by the power transmitted from the power source via the power transmission means. By the reciprocating movement of the piston, the low-pressure fluid inspired by the intake valve is converted into high-pressure fluid and discharged through the discharge valve. In this case, when the fluid pressure at the downstream side of the discharge valve becomes higher than the fluid pressure at the upstream side of the intake valve by a predetermined pressure, the restricting means urges the piston toward the first chamber of the cylinder. The power transmission from the power transmission means to the piston rod is cut off by the displacement of the piston. As a result, in case where the operation of the pressure conversion means is unnecessary, the operation of the pressure conversion means stops, whereby the power loss of the power source can be restrained as much as possible, and the durability of the pressure conversion means is enhanced.

Another specific example is such that the pressure conversion means may be composed of a cylinder; a first cylindrical piston with a bottom that is accommodated in the cylinder in an airtight or liquid-tight and slidable manner and has one end closed and the other end opened in the axial direction; a second piston that slidably enters into the first cylindrical piston from the open end in an airtight or liquid-tight and slidable manner for forming a first chamber in the first cylindrical piston at the side of its closed end and forming a second chamber in the cylinder at the side of the open end of the first cylindrical piston; a piston rod that is connected to the second piston for causing the second piston to move in a reciprocating manner in the cylinder and in the first cylindrical piston in the axial direction by its reciprocating movement in the axial direction; a restricting rod that is connected to the second piston and projects from the closed end of the first cylindrical piston, the restricting rod allowing the reciprocating movement of the second piston to the first cylindrical piston within the predetermined range and displacing integral with the first cylindrical piston due to the engagement with the first cylindrical piston for restricting the displacement of the second piston to the first cylindrical piston outside the predetermined range; an intake valve that is connected to the first chamber for inspiring low-pressure fluid into the first chamber when the second piston is displaced toward the open end of the first cylindrical piston; and a discharge valve that is connected to the first chamber for discharging the high-pressure fluid in the first chamber when the second piston is displaced toward the closed end of the first cylindrical piston, wherein the power transmission means may be configured to cause the piston rod to move in a reciprocating manner in the axial direction with a predetermined range in accordance with the power from the power source, and the restricting means may be configured to direct the high-pressure fluid at the downstream side of the discharge valve into the second chamber and to urge the first cylindrical piston toward its closed end when the fluid pressure at the downstream side of the discharge valve becomes higher than the fluid pressure at the upstream side of the intake valve by a predetermined pressure. In this case too, the power source may be configured to generate rotational force, and the power transmission means may be composed of a cam that rotates in accordance with the rotational force from the power source and converts the rotation into the reciprocating movement of the piston rod in the axial direction.

With this configuration, the second piston in the pressure conversion means makes a reciprocating movement by the power transmitted from the power source via the power transmission means. By the reciprocating movement of the second piston, the low-pressure fluid inspired by the intake valve is converted into high-pressure fluid and discharged through the discharge valve. In this case, when the fluid pressure at the downstream side of the discharge valve becomes higher than the fluid pressure at the upstream side of the intake valve by a predetermined pressure, the restricting means urges the first cylindrical piston toward its closed end and the restricting rod urges the second piston toward the closed end. The power transmission from the power transmission means to the piston rod is cut off by the displacement of the second piston. As a result, in case where the operation of the pressure conversion means is unnecessary, the operation of the pressure conversion means stops, whereby the power loss of the power source can be restrained as much as possible, and the durability of the pressure conversion means is enhanced.

In the latter pressure accumulating apparatus provided with the first and second pistons, the intake valve may be composed of a one-way valve disposed between the cylinder and the first cylindrical piston. The discharge valve may be composed of a one-way valve disposed in a communication path from the first chamber to the second chamber and between the cylinder and the first cylindrical piston. Since the intake valve and the discharge valve are accommodated in the cylinder according to this configuration, the entire apparatus can be made compact.

The specific example of cutting off the power transmission from the power source is as follows. Namely, the power source is configured to generate rotational force, the power transmission means is composed of a rotating rod that transmits the rotation from the power force, pressure conversion driving means that drives the pressure conversion means in accordance with the rotation of the rotating rod, and a clutch that is disposed to the rotating rod between the power source and the pressure conversion driving means for selectively transmitting or cutting the rotational force transmitted through the rotating rod, and the restricting means is composed of a pressure actuator that displaces the rotating rod in the axial direction to disengage the clutch by using the fluid pressure accumulated in the pressure accumulating means or the fluid pressure in the cylinder, when the fluid pressure accumulated in the pressure accumulating means exceeds the predetermined pressure.

More specifically, in this case, the pressure conversion means is composed of, for example, a cylinder, a piston that is accommodated in the cylinder in an airtight or liquid-tight and slidable manner for forming a fluid chamber in the cylinder, a piston rod that is connected to the piston at the side opposite to the fluid chamber for causing the piston to move in the axial direction in the cylinder in a reciprocating manner by the reciprocating movement thereof in the axial direction, an intake valve that is connected to the fluid chamber for inspiring a low-pressure fluid into the fluid chamber upon the displacement of the piston toward the side opposite to the fluid chamber, and a discharge valve that is connected to the fluid chamber for discharging the high-pressure fluid in the fluid chamber upon the displacement of the piston toward the fluid chamber, wherein the pressure conversion driving means may be composed of a cam that converts the rotation of the rotating rod into the reciprocating movement of the piston rod in the axial direction.

In this example, when the fluid pressure accumulated in the pressure accumulating means exceeds the predetermined pressure, so that the pressure conversion by the pressure conversion means becomes unnecessary, the clutch is disengaged by the operation of the pressure actuator, whereby the power transmission from the power source to the pressure conversion means via the rotating rod is cut off. As a result, in case where the operation of the pressure conversion means is unnecessary, the operation of the pressure conversion means stops, whereby the power loss of the power source can be restrained as much as possible, and the durability of the pressure conversion means is enhanced.

As still another specific example, the restricting means may be configured, for example, to restrict the output of the fluid pressure from the pressure conversion means to the pressure accumulating means by changing the transmission ratio of the power from the power source to the pressure conversion means by the power transmission means in accordance with the fluid pressure accumulated in the pressure accumulating means. In this case, the restricting means may be configured to change the transmission ratio of the power from the power source to the pressure conversion means by the power transmission means to the small value as the fluid pressure accumulated in the pressure accumulating means is made close to the predetermined pressure.

Specifically, the power source may be configured to generate rotational force, and the power transmission means may be composed of a transmission to which the rotation from the power source is inputted and which outputs the inputted rotation as gears changed, and pressure conversion driving means that drives the pressure conversion means by the output from the transmission, and further, the restricting means may be composed of a pressure actuator that variably controls the gear ratio of the transmission by using the fluid pressure accumulated in the pressure accumulating means.

More specifically, the pressure conversion means is composed of, for example, a cylinder, a piston that is accommodated in the cylinder in an airtight or liquid-tight and slidable manner for forming a fluid chamber in the cylinder, a piston rod that is connected to the piston at the side opposite to the fluid chamber for causing the piston to move in the axial direction in the cylinder in a reciprocating manner by the reciprocating movement thereof in the axial direction, an intake valve that is connected to the fluid chamber for inspiring a low-pressure fluid into the fluid chamber upon the displacement of the piston toward the side opposite to the fluid chamber, and a discharge valve that is connected to the fluid chamber for discharging the high-pressure fluid in the fluid chamber upon the displacement of the piston toward the fluid chamber, wherein the pressure conversion driving means may be composed of a cam that converts the rotation of the rotating rod into the reciprocating movement of the piston rod in the axial direction.

With this configuration, the power transmission ratio from the power source to the pressure conversion means by the power transmission means is changed in accordance with the fluid pressure accumulated in the pressure accumulating means, whereby the output of the fluid pressure from the pressure conversion means to the pressure accumulating means is restricted. As a result, the power loss of the power source is restrained as much as possible, and the durability of the pressure conversion means is enhanced.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

BEST MODE OF CARRYING OUT THE INVENTION

First Embodiment

Figure 1:
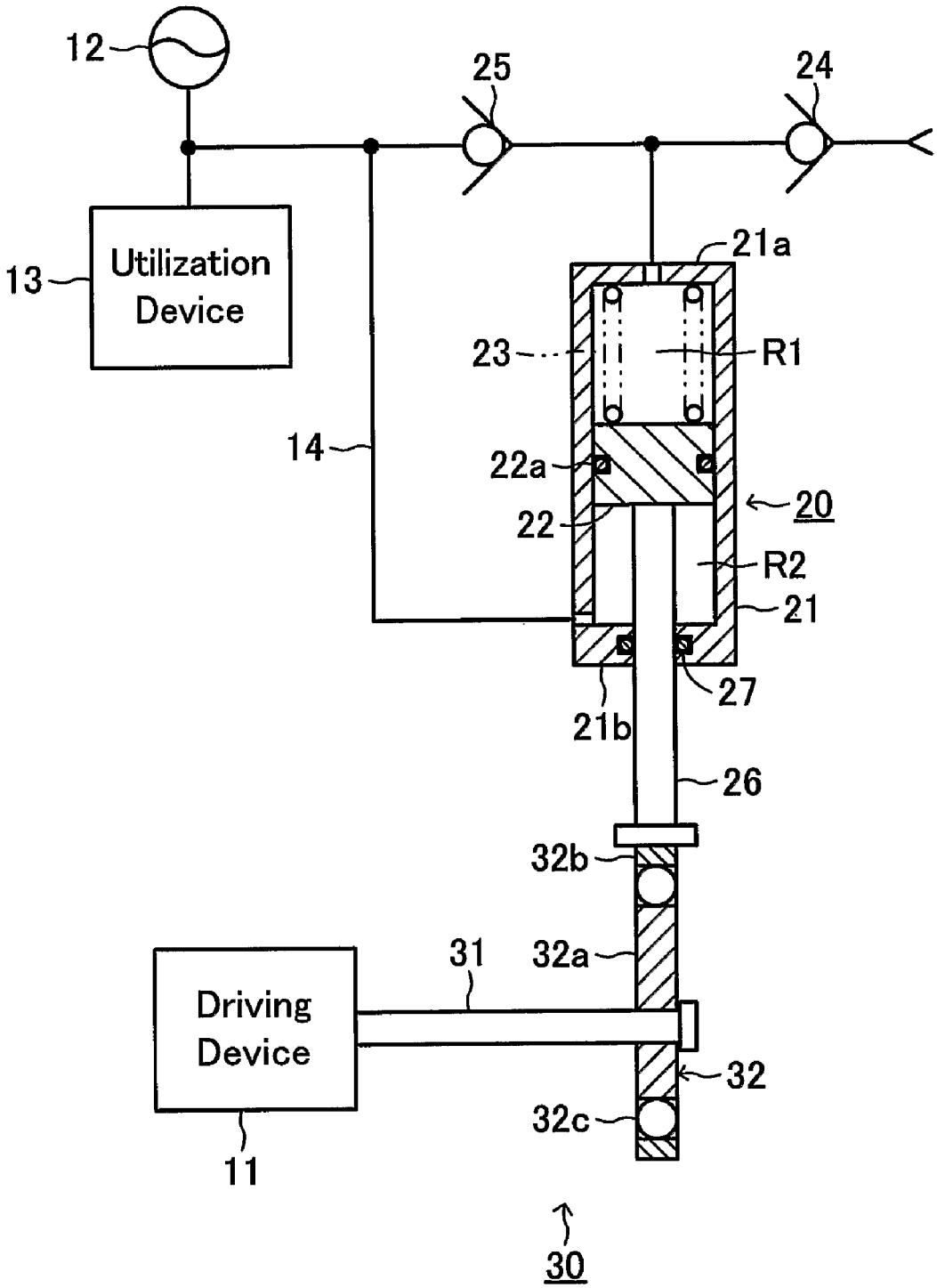
FIG. 1 is an overall schematic view showing a pressure accumulating apparatus according to a first embodiment of the present invention.

A first embodiment of the present invention will be explained with reference to drawings. FIG. 1 is a schematic view showing an overall of a pressure accumulating apparatus according to the first embodiment of the invention. This pressure accumulating apparatus is adopted to, for example, a vehicle. It accumulates air pressure that is used for a control of a vehicle.

The pressure accumulating apparatus has a driving device 11 serving as a power source for generating power, a pressure conversion mechanism 20 serving as pressure conversion means for converting air pressure, that is fluid pressure, by using the power transmitted from the driving device 11, a power transmission mechanism 30 that transmits the power from the driving device 11 to the pressure conversion mechanism 20, and an accumulator 12 serving as pressure accumulating means for accumulating high-pressure air that is converted at the pressure conversion mechanism 20.

The driving device 11 is composed of, for example, an engine and an output device that outputs driving force of the engine. The pressure conversion mechanism 20 has a cylindrical cylinder 21 having a pair of bottom sections 21*a* and 21*b*. The cylinder 21 accommodates a piston 22, having attached thereto an O-ring 22*a* serving as a sealing member at the outer peripheral surface, in an airtight and slidable manner in the axial direction. The piston 22 divides the inside of the cylinder 21 into a first chamber R1 and a second chamber R2. A coil spring 23 is incorporated in the first chamber R1. The coil spring 23 urges the piston 22 against the second chamber R2.

The first chamber R1 communicates with atmospheric air via an intake valve 24 that is constituted by a check valve. The intake valve 24 directs air into the first chamber R1 when the piston 22 displaces toward the second chamber R2. The first chamber R1 further communicates with the accumulator 12 via a discharge valve 25 constituted by a check valve. The discharge valve 25 discharges the high-pressure air in the first chamber R1 when the piston 22 displaces toward the first chamber R1. A piston rod 26 enters into the second chamber R2 so as to be capable of advancing or retreating via the bottom section 21*b* of the cylinder 21 in an airtight manner. The piston rod 26 is connected to the piston 21 so as to be integrally displaced. A sealing member 27 attached on the inner peripheral surface of the bottom section 21*b* is disposed between the piston rod 26 and the bottom section 21*b*.

The power transmission mechanism 30 is composed of a rotating rod 31 that is rotatably driven about the axis by the driving device 11, and an eccentric cam 32. The eccentric cam 32 is composed of a circular plate 32*a*, ring 32*b*, and a great number of balls 32*c*. The circular plate 32*a* is fixed to the rotating rod 31 so as to be integrally rotated with the rod 31 at the eccentric position. The ring 32*b* is installed on the outer peripheral surface of the circular plate 32*a* via a great number of balls 32*c* at its inner peripheral surface so as to relatively rotate with the circular plate 32*a*, and slidably supports the lower face of the piston rod 26 at a part of the outer peripheral surface (the position at the upper section in the figure). Accordingly, the eccentric cam 32 moves up and down the illustrated upper end position of the ring 32*b* by the rotation of the circular plate 32*a* with the rotation of the rotating rod 31 whereby the piston rod 26 is reciprocatingly moved in the axial direction, i.e., in the upward and downward direction within a predetermined range shown in the figure.

A utilization device 13 is connected to the accumulator 12. The utilization device 13 utilizes high-pressure air accumulated in the accumulator 12. It is, for example, a brake assist device for assisting an operation of stepping on a brake pedal by a driver in a vehicle.

An air path 14 that directs the high-pressure air accumulated in the accumulator 12 (i.e., air pressure at the downstream side of a discharge valve 25) toward the second chamber R2 in the cylinder 21 is disposed at the accumulator 12 (i.e., downstream of the discharge valve 25). This air path 14 may be a path formed by the inner peripheral surface of a conduit or may be a path formed in a block composing the cylinder 21 and discharge valve 25.

Subsequently, an operation of the first embodiment thus configured will be explained. When the rotating rod 31 is rotatably driven by the driving device 11, the eccentric cam 32 causes the piston rod 26 and the piston 22 to move reciprocatingly up and down. When the eccentric cam 32 pushes up the piston rod 26 and the piston 22 against the urging force of the coil spring 23 in the downward direction, the later-described air in the first chamber R1 is compressed and converted into high-pressure air. The air converted into high-pressure state is supplied to the accumulator 12 and the second chamber R2 via the discharge valve 25. When the piston 22 reaches the uppermost point, the piston 22 and piston rod 26 then moves downward by the urging force of the coil spring 23 and force by their own weight of the piston 22 and the piston rod 26 (this force is hereinafter referred to as urging force by the coil spring 23 or the like). It should be noted that, unless the axial direction of the cylinder 21 is vertical direction, the force by their own weight of the piston 22 and the piston rod 26 varies in accordance with the axial direction.

By the movement of the piston 22 in the downward direction, air having atmospheric pressure is inspired into the first chamber R1 in the cylinder 21 through the intake valve 24. After the piston 22 and the piston rod 26 reach the lowermost point, the piston 22 and the piston rod 26 move up by the eccentric cam 32 as described above, so that the compressed high-pressure air in the first chamber R1 is supplied to the accumulator 12 through the discharge valve 25. The air in the accumulator 12 gradually becomes a high-pressure state by the reciprocating movement of the piston 22 and piston rod 26 described above, with the result that high-pressure air is accumulated in the accumulator 12.

On the other hand, the accumulator 12 and the downstream side of the discharge valve 25 communicates with the second chamber R2 in the cylinder 21 via the air path 14. Therefore, when the air pressure in the accumulator 12 increases, the air pressure in the second chamber R2 also increases. When the urging force of the piston 22 in the upward direction by the high-pressure air in the second chamber R2 exceeds the urging force by the coil spring 23 or the like, the piston 22 and the piston rod 26 stand still at the uppermost position at this point. Specifically, when the air pressure in the accumulator 12, i.e., the air pressure at the downstream side of the discharge valve 25 becomes higher than the air pressure (atmospheric pressure) at the upstream side of the intake valve 24 by a predetermined pressure, the air pressure in the second chamber R2 keeps the piston 22 and the piston rod 26 at the uppermost position. In the state where the piston 22 and the piston rod 26 are kept to be the uppermost position, the piston rod 26 is disconnected from the eccentric cam 32, so that the piston rod 26 is not pushed in the upward direction by the eccentric cam 32, even if the eccentric cam 32 is rotatably driven via the rotating rod 31. Specifically, the power transmission from the power transmission mechanism 30 to the pressure conversion mechanism 20 is cut off.

On the other hand, the high-pressure air accumulated in the accumulator 12 is utilized by the utilization device 13. When the air pressure in the accumulator 12 decreases due to the use by the utilization device 13, the air pressure in the second chamber R2 in the cylinder 21 also decreases. Then, the piston 22 and the piston rod 26 are pushed downward by the urging force of the coil spring 23 or the like, and the lower end face of the piston rod 26 again comes in contact with the ring 32*b* of the eccentric cam 32. As a result, the pressure conversion mechanism 20 again converts the atmospheric pressure into high-pressure state by the rotation of the eccentric cam 32, and starts to accumulate the high-pressure air in the accumulator 12. The aforesaid operation will be repeated after that.

As explained above, in the first embodiment, when the air pressure in the accumulator 12, i.e., air pressure at the downstream side of the discharge valve 25, becomes higher than the air pressure (atmospheric pressure) at the upstream side of the intake valve 24 by a predetermined pressure, the air pressure in the second chamber R2 keeps the piston 22 and the piston rod 26 at the uppermost position. Although the eccentric cam 32 is rotatably driven by the driving device 11, the operations of the piston 22 and the piston rod 26, i.e., the operation of the pressure conversion mechanism 20 stops with this state. Therefore, power loss of the driving device 11 can be restrained, and further, durability of the pressure conversion mechanism 20 is enhanced.

First Modified Example of First Embodiment

Figure 2:
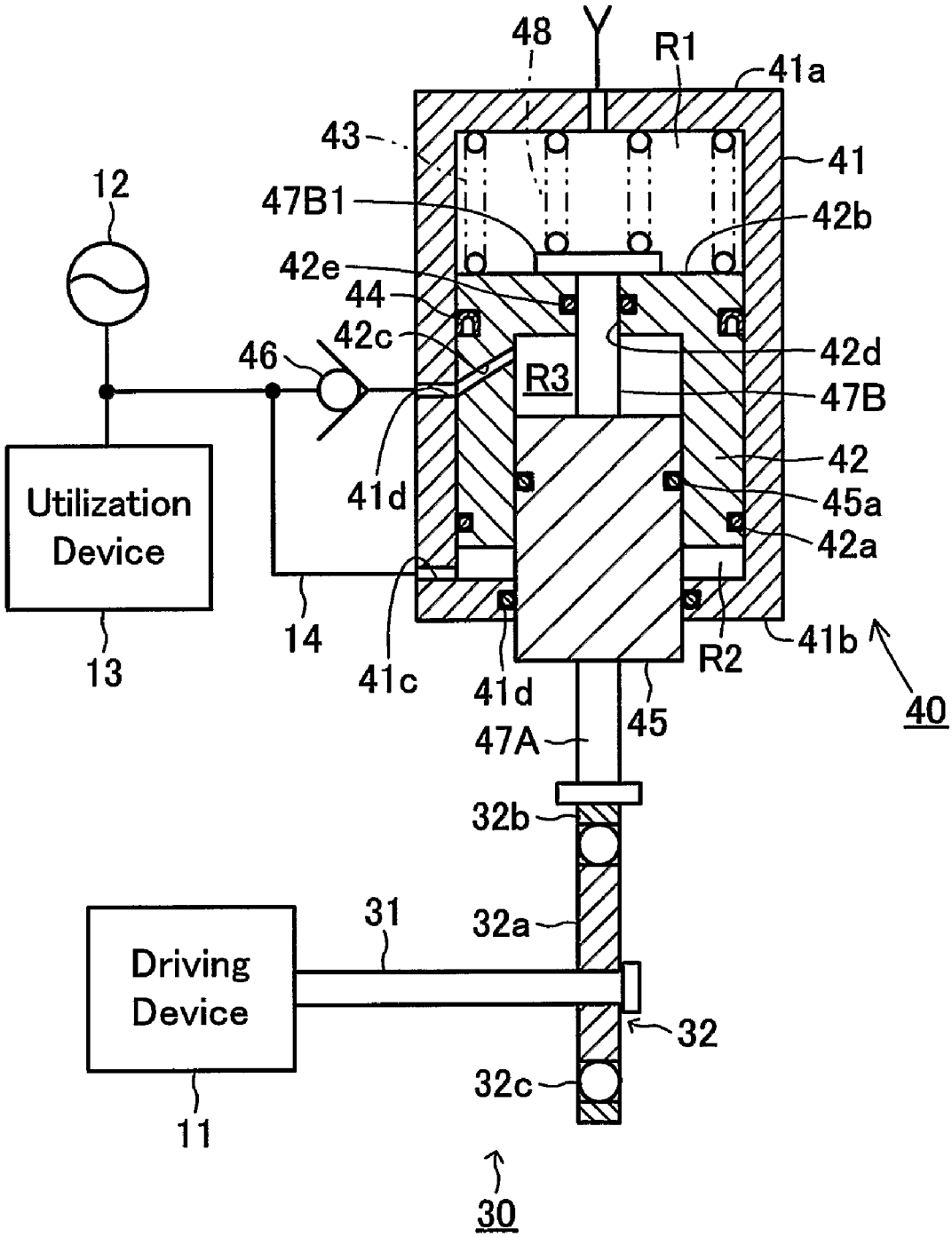
FIG. 2 is an overall schematic view showing a pressure accumulating apparatus according to a first modified example of the first embodiment.

Subsequently explained with reference to FIG. 2 is a pressure accumulating apparatus according to a first modified example of the first embodiment. This pressure accumulating apparatus has a pressure conversion mechanism 40 that is obtained by modifying the pressure conversion mechanism 20 in the first embodiment. The other components, such as driving device 11, accumulator 12, utilization device 13, air path 14, and power transmission mechanism 30, are same as those in the first embodiment, so that only the pressure conversion mechanism 40 will be explained.

The pressure conversion mechanism 40 has a cylindrical cylinder 41 having a pair of bottom sections 41*a* and 41*b*. The cylinder 41 accommodates a first piston 42, having attached thereto an O-ring 42*a* serving as a sealing member at the outer peripheral surface, in an airtight and slidable manner in the axial direction. The piston 42 is formed into a cylindrical shape having a bottom section 42*b*, and divides the inside of the cylinder 41 into a first chamber R1 and a second chamber R2. The first chamber R1 communicates with atmospheric air. The second chamber R2 communicates with the accumulator 12 and the downstream side of the discharge valve 46 via a path 41*c* provided at the cylinder 41 and the air path 14. A coil spring 43 is incorporated in the first chamber R1. The coil spring 43 urges the first piston 42 against the second chamber R2. Attached at the outer peripheral surface of the first piston 42 is a cup seal member 44 that has a U-shaped section, is formed into a ring-like shape and functions as a one-way valve. This cup seal member 44 functions as the intake valve 24 in the first embodiment. It directs the atmospheric air in the first chamber R1 to a third chamber R3.

The cylinder 41 and the first piston 42 accommodate a second piston 45 in an airtight and slidable manner in the axial direction. An O-ring 41*d* is attached on the inner peripheral surface of the bottom section 41*b* of the cylinder 41 so as to maintain the airtightness with the outer peripheral surface of the second piston 45. An O-ring 45*a* is attached on the outer peripheral surface of the second piston 45 so as to maintain the airtightness with the inner peripheral surface of the first piston 42. The second piston 45 forms a third chamber R3 in the first piston 42. The third chamber R3 communicates with the accumulator 12 through a path 42*c* disposed at the first piston 42, a path 41*d* disposed at the cylinder 41 and the discharge valve 46. Note that the discharge valve 46 is the same as the discharge valve 25 in the first embodiment. The atmospheric air in the first chamber R1 is inspired into the third chamber R3 via the cup seal member 44 and the path 42*c*. It should be noted that the air in the third chamber R3 is not directed into the first chamber R1 via the path 42*c* and the cup seal member 44.

A pair of piston rods 47A that integrally displaces with the second piston 45 is connected to the bottom face of the second piston 45. The piston rod 47A is slidably supported by the ring 32*b* of the eccentric cam 32 at its lower end face. A piston rod 47B that integrally displaces with the second piston 45 is connected to the second piston 45 at its top face. The piston rod 47B projects from the bottom section 42 in the upward direction so as to be capable of advancing or retreating via a through-hole 42*d* formed at the bottom section 42*b* of the first piston 42. An O-ring 42*e* is attached to the inner peripheral surface of the through-hole 42*d* between the piston rod 47B and the through-hole 42*d* so as to maintain the airtightness between the first chamber R1 and the third chamber R3. A stopper plate 47B1 accommodated in the first chamber R1 is fixed to the upper end of the piston rod 47B. The stopper plate 47B1 restricts the displacement of the second piston 45 in the downward direction. It is urged in the downward direction by a coil spring 48 accommodated in the first chamber R1.

Subsequently, an operation of the first modified example of the first embodiment thus configured will be explained. When the rotating rod 31 is rotatably driven by the driving device 11, the eccentric cam 32 starts to cause the piston rods 47A, 47B and the second piston 45 to move reciprocatingly up and down. When the eccentric cam 32 pushes the piston rods 47A, 47B and the second piston 45 in the upward direction against the urging force of the coil spring 48 in the downward direction, the air in the third chamber R3 is compressed and converted into high-pressure state. The air converted into the high-pressure state is supplied to the accumulator 12 and the second chamber R2 through the paths 42*c* and 41*d* and the discharge valve 46. When the second piston 45 reaches the uppermost point, the second piston 45 and the piston rods 47A and 47B then move downward by the urging force of the coil spring 48 and their own weight of the second piston 45 and the piston rods 47A and 47B (this force is referred to as urging force by the coil spring 48 or the like hereinafter). It should be noted that, unless the axial direction of the cylinder 41 is vertical direction, the force by their own weight of the second piston 45 and the piston rods 47A and 47B varies in accordance with the axial direction.

By the movement of the second piston 45 in the downward direction, air having atmospheric pressure is inspired into the third chamber R3 through the first chamber R1, the cup seal member 44 and the path 42*c*. After the second piston 45 and the piston rods 47A and 47B reach the lowermost point, the second piston 45 and the piston rods 47A and 47B move up by the eccentric cam 32 as described above, so that the compressed high-pressure air in the third chamber R3 is supplied to the accumulator 12 and the second chamber R2 through the paths 42*c* and 41*d* and the discharge valve 46. The air in the accumulator 12 gradually becomes a high-pressure state by the reciprocating movement of the second piston 45 and piston rods 47A and 47B described above, with the result that high-pressure air is accumulated in the accumulator 12.

On the other hand, the accumulator 12 also communicates with the second chamber R2 in the cylinder 21 via the air path 14. Therefore, when the air pressure in the accumulator 12 increases, the air pressure in the second chamber R2 also increases. The increased air pressure in the second chamber R2 pushes the first piston 42 in the upward direction against the urging force by the coil springs 43 and 48 and the urging force by their own weight of the first and second pistons 42 and 45. It should be noted that the urging force by their own weight of the first and second pistons 42 and 45 also varies depending upon the angle to the cylinder 41 in the vertical direction. When the push-up force by the increased air pressure in the second chamber R2 exceeds the urging force by the coil springs 43 and 48 and the urging force by their own weight of the first and second pistons 42 and 45, the first piston 42 stands still at the uppermost position with the second piston 45. Specifically, when the air pressure in the accumulator 12, i.e., the air pressure at the downstream side of the discharge valve 46 becomes higher than the air pressure (atmospheric pressure) in the first chamber R1 by a predetermined pressure, the air pressure in the second chamber R2 keeps the first and second pistons 42 and 45 at the uppermost position. In the state where the first and second pistons 42 and 45 are kept to be the uppermost position, the piston rod 47A is disconnected from the eccentric cam 32, so that it is not pushed in the upward direction by the eccentric cam 32, even if the eccentric cam 32 is rotatably driven via the rotating rod 31. Specifically, the power transmission from the power transmission mechanism 30 to the pressure conversion mechanism 20 is cut off.

On the other hand, the high-pressure air accumulated in the accumulator 12 is utilized by the utilization device 13. When the air pressure in the accumulator 12 decreases due to the use by the utilization device 13, the air pressure in the second chamber R2 in the cylinder 41 also decreases. Then, the first and second pistons 42 and 45 are pushed downward by the urging force of the coil springs 43 and 48 and their own weight of the first and second pistons 42 and 45, and the lower end face of the piston rod 47A again comes in contact with the ring 32*b* of the eccentric cam 32. As a result, the pressure conversion mechanism 40 again converts the atmospheric pressure into high-pressure state by the rotation of the eccentric cam 32, and starts to accumulate the high-pressure air in the accumulator 12. The aforesaid operation will be repeated after that.

As explained above, in the first modified example of the first embodiment, when the air pressure in the accumulator 12, i.e., air pressure at the downstream side of the discharge valve 46, becomes higher than the air pressure (atmospheric pressure) in the first chamber R1 by a predetermined pressure, the air pressure in the second chamber R2 keeps the first piston 42, second piston 45 and the piston rods 47A and 47B at the uppermost position. Accordingly, the effect same as that in the first embodiment is expected. Since the cup seal member 44, which functions in the same manner as the intake valve 24 in the first embodiment, is installed between the cylinder 41 and the first piston 42, the overall apparatus can be made compact.

Second Modified Example of First Embodiment

Subsequently, a second modified example of the first embodiment will be explained with reference to FIG. 3. A pressure accumulating apparatus according to the second modified example has a cup seal member 49 that has an U-shaped section, is formed into a ring-like shape and functions as a one-way valve, instead of the discharge valve 46 in the first modified example. The cup seal member 49 is similarly made as the cup seal member 44. It is installed to the outer peripheral surface of the first piston 42 at the position between the path 42*c* and the lower end face of the first piston 42. The cup seal member 49 allows the supply of the air in the third chamber R3 to the second chamber R2 via the path 42*c*. Note that the air in the second chamber R2 is not directed into the third chamber R3 via the cup seal member 49 and the path 42*c*. In this case too, the accumulator 12 communicates with the second chamber R2 through the air path 14.

In the second modified example thus configured, the high-pressure air in the third chamber R3 compressed by the rise of the second piston 45 is supplied to the second chamber R2 and the accumulator 12 through the path 42*c* and the cup seal member 49. The other operations are the same as those in the aforesaid first modified example. Therefore, according to the second modified example, the effect same as that in the first modified example is expected. Further, since the cup seal member 49 functioning in the same manner as the discharge valve 46 in the first modified example is installed between the cylinder 41 and the first piston 42, the overall apparatus can further be made compact.

Second Embodiment

Subsequently, a pressure accumulating apparatus according to the second embodiment will be explained with reference to FIG. 4. This pressure accumulating apparatus has the driving device 11, accumulator 12 and utilization device 13, like the pressure accumulating apparatus in the first embodiment. An improvement is given to the pressure conversion mechanism 20 and the power transmission mechanism 30 in the first embodiment. The pressure accumulating apparatus in the second embodiment further has a restricting mechanism 50 corresponding to restricting means. The points different from the first embodiment will only be explained hereinafter.

The cylinder 21 composing the pressure conversion mechanism 20 in the second embodiment is open without being provided with the bottom section 21*b*, and has only the first chamber R1. The air path 14 connected to the second chamber R2 in the first embodiment is not present. The other configuration of the pressure conversion mechanism 20 is the same as that of the pressure conversion mechanism 20 in the first embodiment.

In the power transmission mechanism 30, the rotating rod 31 in the first embodiment is divided into a rotating rod 31A connected to the driving device 11 and a rotating rod 31B that holds the eccentric cam 32 and is provided so as to be displaceable in the axial direction. Both rotating rods 31A and 31B are concentrically arranged. A clutch 33 composed of a fixed plate 33*a* and movable plate 33*b* is arranged between both rotating rods 31A and 31B. The clutch 33 transmits the rotation of the rotating rod 31A to the rotating rod 31B with the state in which the rotating rod 31B is located at the leftward position in the figure and the fixed plate 33*a* and the movable plate 33*b* are brought into contact with each other. On the other hand, the clutch 33 separates the movable plate 33*b* from the fixed plate 33*a* so as to cut off the power transmission from the rotating rod 31A to the rotating rod 31B with the state in which the rotating rod 31B is displaced in the rightward direction from the illustrated state by the restricting mechanism 50 described later.

In the power transmission from the rotating rod 31B to the eccentric cam 32, the rotating force is transmitted from the rotating rod 31B to the rotating plate 32*a* of the eccentric cam 32 by a spline coupling. Specifically, an external spline member 34 having external spline is fixed to the outer peripheral surface of the rotating rod 31B so as to be integrally rotated with the rotating rod 31B. On the other hand, internal spline that is meshed with the external spline is formed at the inner peripheral surface of a through-hole formed at the rotating plate 32*a* through which the rotating rod 31B penetrates. With this configuration, the rotating rod 31B is engaged with the rotating plate 32*a* so as to be displaceable in the axial direction and integrally rotatable with the rotating plate 32*a*.

The restricting mechanism 50 has a pair of bottom sections 51*a* and 51*b*. It has a cylindrical cylinder 51 concentrically formed with the rotating rods 31A and 31B. The cylinder 51 accommodates a piston 52, having attached thereto an O-ring 52*a* serving as a sealing member at the outer peripheral surface, in an airtight and slidable manner in the axial direction. The piston 52 divides the inside of the cylinder 51 into a first chamber R11 and a second chamber R21. The first chamber R11 communicates with atmospheric air. A coil spring 53 is incorporated into the first chamber R11. The coil spring 53 urges the piston 52 toward the second chamber R21.

A piston rod 54 that is formed integral with the rotating rod 31B enters into the second chamber R21 so as to be capable of advancing or retreating via the bottom section 51*b* of the cylinder 51 in an airtight manner. The piston rod 54 is connected to the piston 52 so as to be integrally displaced. An O-ring 51*c* is attached to the inner peripheral surface of the through-hole formed at the bottom section 51*b* of the cylinder 51 so as to maintain the airtightness with the piston rod 53. A path 51*d* that communicates with the second chamber R21 is provided at the cylinder 51. The second chamber R21 communicates with the first chamber R1 of the cylinder 21 via the path 51*d* and the air path 54.

Subsequently, the operation of the second embodiment thus configured will be explained. With the state in which the air pressure of the air accumulated in the accumulator 12 is not so high, the air pressure in the second chamber R21 of the cylinder 51 is low, so that the piston 52 and the piston rod 54 are moved to the left position by the urging force of the coil spring 53 (illustrated state). With this state, both rotating rods 31A and 31B are connected so as to be capable of transmitting power by the clutch 33. Accordingly, when the rotating rod 31 is rotatably driven by the driving device 11 with this state, the eccentric cam 32 starts to reciprocatingly move the piston rod 26 and the piston 22 in the upward direction or downward direction. Like the first embodiment, the atmospheric air is converted into high-pressure air by the reciprocating movement of the piston rod 26 and the piston 22, and then, the converted high-pressure air is supplied to the accumulator 12 through the discharge valve 25, whereby high-pressure air is accumulated in the accumulator 12.

During the process of accumulating high-pressure air in the accumulator 12, if the pressure of the compressed air in the first chamber R1 of the cylinder 21 is lower than the air pressure in the accumulator 12, the compressed air in the first chamber R1 is not supplied to the accumulator 12 due to the action of the discharge valve 25, with the result that the air pressure in the first chamber R1 is increased by the rising movement of the piston 21. When the pressure of the compressed air in the first chamber R1 becomes higher than the air pressure in the accumulator 12, the compressed air in the first chamber R1 is supplied to the accumulator 12 through the discharge valve 25. Accordingly, the air pressure in the first chamber R1 becomes not so high in the state in which the air pressure in the accumulator 12 is not so high, and hence, the air pressure in the second chamber R21 of the cylinder 51 becomes not so high.

However, when the air pressure in the accumulator 12 increases, the air pressure of the compressed air in the first chamber R1 increases with the increased air pressure in the accumulator 12 due to the rising movement of the piston 22. The air pressure in the first chamber R1 is transmitted to the second chamber R21 in the cylinder 51 via the air path 54, so that the air pressure in the second chamber R21 also increases. As a result, the increased air pressure in the second chamber R21 displaces the piston 52 in the rightward direction in the figure against the urging force of the coil spring 53. The displacement of the piston 52 in the rightward direction also displaces the piston rod 54 and the rotating rod 31B in the rightward direction in the figure, which brings a disengagement of the clutch 33. It should be noted that, even in the displacement of the rotating rod 31B, the eccentric cam 32 is kept to be the previous position and the rotating plate 32*a* and the external spline member 34 are kept to be meshed with each other. Even if the rotating rod 31A rotates, this rotation is not transmitted to the rotating rod 31B with this state, whereby the operation of the pressure conversion mechanism 20 is stopped.

On the other hand, when the air pressure in the accumulator 12 decreases due to the use of the high-pressure air accumulated in the accumulator 12 by the utilization device 13, the air pressure in the first chamber R1 of the cylinder 21 by the rising movement of the piston 22 becomes not so high as described above. Accordingly, the air pressure in the second chamber R21 in the cylinder 51 is decreased, whereby the piston 52 is displaced in the leftward direction in the figure by the urging force of the coil spring 53. This also displaces the piston rod 53 and the rotating rod 31B in the leftward direction in the figure, which brings the clutch 33 into the engaged state. As a result, the pressure conversion mechanism 20 starts again to convert the atmospheric air into high-pressure air by the rotation of the eccentric cam 32 and accumulate the converted air in the accumulator 12, as described above. The foregoing operation will be repeated after that.

As explained above, when the air pressure in the accumulator 12, i.e., air pressure at the downstream side of the discharge valve 25 becomes higher than the air pressure (atmospheric pressure) at the upstream side of the intake valve 24 by a predetermined pressure, the clutch 33 is brought into a disengaged state in the second embodiment. Although the rotating rod 31A is rotatably driven by the driving device 11 with this state, the rotation of the rotating rod 31B stops, so that the operation of the pressure conversion mechanism 20 stops. Accordingly, the power loss of the driving device 11 can be restrained, and further, the durability of the pressure conversion mechanism 20 is enhanced.

In the second embodiment, the accumulator 12, i.e., the downstream side of the discharge valve 25 may be communicated with the second chamber R21 in the cylinder 51, instead of communicating the first chamber R1 in the cylinder 21 with the second chamber R21 in the cylinder 51. In this case, the accumulator 12, i.e., the downstream side of the discharge valve 25 may be communicated with the second chamber R21 in the cylinder 51 by an air path 55 as shown by a broken line in FIG. 4. With this configuration, when the air pressure accumulated in the accumulator 12 is low, the air pressure in the second chamber R21 in the cylinder 51 is also decreased, whereby the clutch 33 is engaged by the displacement of the piston 52 in the leftward direction in the figure, and the pressure conversion mechanism 20 is operated. On the other hand, when the air pressure in the accumulator 12 increases, the air pressure in the second chamber R21 in the cylinder 51 also increases. Therefore, the clutch 33 is disengaged by the displacement of the piston 52 in the rightward direction, whereby the operation of the pressure conversion mechanism 20 stops. The effect same as that of the second embodiment can also be expected according to this modified example.

Third Embodiment

Subsequently, a pressure accumulating apparatus according to the third embodiment of the invention will be explained with reference to FIG. 5. This pressure accumulating apparatus has the driving device 11, accumulator 12 and utilization device 13 same as those in the second embodiment. It has a power transmission mechanism 60 and a restricting mechanism 70 instead of the power transmission mechanism 30 and the restricting mechanism 50 in the second embodiment. The points different from the second embodiment will only be explained hereinafter.

The power transmission mechanism 60 has a rotating rod 61A that is rotatably driven by the driving device 11 connected to its one end, and a rotating rod 61B that rotatably drives an eccentric cam 62 connected to its one end. The eccentric cam 62 is composed, in the same manner as the eccentric cam 32 in the first and second embodiments, of a circular plate 62*a*, ring 62*b*, and balls 62*c*. A continuously variable transmission mechanism (CVT) 63 is provided between both rotating rods 61A and 61B.

The continuously variable transmission mechanism 63 has first and second variable pulleys around which a belt 63*a* is entrained. The first variable pulley has a fixed sheave 63*b* that is fixed to the rotating rod 61A so as to rotate integral with the rotating rod 61A, and a movable sheave 63*c* that is spline-coupled to the rotating rod 61A so as to be displaceable in the axial direction and rotatable integral with the rotating rod 61A. The movable sheave 63*c* is urged toward the leftward direction in the figure by a coil spring 63*e* supported by a stopper 63*d* that is fixed to the other end of the rotating rod 61A. The second variable pulley has a fixed sheave 63*f* that is fixed to the rotating rod 61B so as to rotate integral with the rotating rod 61B, and a movable sheave 63*g* that is spline-coupled to the rotating rod 61B so as to be displaceable in the axial direction and rotatable integral with the rotating rod 61B. The movable sheave 63*g* is urged toward the rightward direction in the figure by a coil spring 63*h* supported by a later-described piston 72 that is fixed to the other end of the rotating rod 61B.

The restricting mechanism 70 has a bottom section 71*a*. It has a cylindrical cylinder 71 concentrically formed with the rotating rod 61B. The cylinder 71 accommodates a piston 72, having attached thereto an O-ring 72*a* serving as a sealing member at the outer peripheral surface, in an airtight and slidable manner in the axial direction. The piston 72 forms a first chamber R11 at the side of the bottom section 71*a* in the cylinder 71. The first chamber R11 communicates with the accumulator 12 and the downstream side of the discharge valve 25 via an air path 73. The other end of the rotating rod 61B is connected to the piston 72 at the open side of the cylinder 71 so as to rotate integral with the piston 72.

Subsequently, the operation of the third embodiment thus configured will be explained. In the state in which the air pressure of the air accumulated in the accumulator 12 is not so high, the air pressure in the first chamber R11 in the cylinder 71 is low as described later, so that the piston 72 is moved to the left position by the urging force of the coil spring 63*h* (illustrated state). With this state, the space between the fixed sheave 63*f* and the movable sheave 63*g* is great, i.e., the rotational radius of the belt 63*a* at the second variable pulley is set small. In this case, the space between the fixed sheave 63*b* and the movable sheave 63*c* is small, i.e., the rotational radius of the belt 63*a* at the first variable pulley is set great. Accordingly, the ratio of the revolution of the rotating rod 61B to the revolution of the rotating rod 61A driven by the driving device 11 is set great, whereby the rotating plate 62*a* of the eccentric cam 62 is rotated with high speed due to the rotation of the rotating rod 61A.

The eccentric cam 62 causes the piston rod 62 and the piston 22 to move up and down in a reciprocating manner with high speed due to the rotation of the rotating plate 62*a*. Like the first and second embodiments, the atmospheric air is converted into high-pressure air by the reciprocating movement of the piston rod 26 and the piston 22. Therefore, the converted high-pressure air is supplied to the accumulator 12 via the discharge valve 25, whereby the high-pressure air is accumulated in the accumulator 12. Specifically, the high-pressure air is accumulated in the accumulator 12 with a state of great conversion output of the pressure conversion mechanism 20.

During the process of accumulating high-pressure air in the accumulator 12, the air pressure in the accumulator 12 is also supplied to the first chamber R11 in the cylinder 71 through the air path 73. Accordingly, when the air pressure in the accumulator 12 is low, the piston 72 is located at the leftward position in the figure in the cylinder 71. However, when the air pressure in the accumulator 12 increases, the piston 72 displaces in the rightward direction in the figure against the urging force of the coil spring 63*h* with the increase of the air pressure. The displacement of the piston 72 in the rightward direction displaces the movable sheave 63*g* in the rightward direction in the figure. With this movement, the space between the fixed sheave 63*f* and the movable sheave 63*g* becomes narrow, i.e., the rotational radius of the belt 63*a* at the second variable pulley is set great, as the air pressure in the accumulator 12 increases. On the contrary, the space between the fixed sheave 63*b* and the movable sheave 63*c* becomes wide, i.e., the rotational radius of the belt 63*a* at the first variable pulley is set small. As a result, the ratio of the revolution of the rotating rod 61B to the revolution of the rotating rod 61A driven by the driving device 11 is reduced as the air pressure in the accumulator 12 increases, whereby the revolution speed of the rotating plate 62*a* of the eccentric cam 62 reduces. Accordingly, the eccentric cam 62 causes the piston rod 26 and the piston 22 to move up and down in a reciprocating manner with low speed. In other words, the conversion output of the pressure conversion mechanism 20 is decreased.

On the other hand, when the high-pressure air in the accumulator 12 is utilized by the utilization device 13, the air pressure in the accumulator 12 and the first chamber R11 in the cylinder 71 decreases. By the decrease in the air pressure in the first chamber R11, the piston 72 displaces in the leftward direction in the figure, so that the space between the fixed sheave 63*f* and the movable sheave 63*g* increases and the space between the fixed sheave 63*b* and the movable sheave 63*c* decreases as described above. Therefore, the rotating plate 62*a* of the eccentric cam 63 starts to rotate again with high speed, whereby the eccentric cam 62 causes the piston rod 26 and the piston 22 to move up and down in a reciprocating manner with high speed. Accordingly, high-pressure air is again accumulated in the accumulator 12 in the state of great conversion output of the pressure conversion mechanism 20. The foregoing operation will be repeated after that.

As explained above, the ratio of the revolution of the rotating rod 61B to the revolution of the rotating rod 61A is set small due to the action of the continuously variable transmission mechanism 63 in the power transmission mechanism 60, as the air pressure in the accumulator 12 increases, whereby the revolution speed of the rotating plate 62*a* of the eccentric cam 62 is slowed. Specifically, as the air pressure in the accumulator 12 increases, the power transmission mechanism 60 holds down the power transmission from the driving device 11 to the pressure conversion mechanism 20. Consequently, the pressure conversion mechanism 20 is driven by driving force, according to need, by the power transmission mechanism 60, whereby the power loss from the driving device 11 is restrained, and further, durability of the pressure conversion mechanism 20 is enhanced.

Other Modified Examples of First to Third Embodiments

In the pressure accumulating apparatus according to the first embodiment (including the first and second modified examples), second embodiment and third embodiment, air having pressure higher than the atmospheric pressure is accumulated in the accumulator 12. In the following, a modified example will be explained in which these pressure accumulating apparatus are modified such that air with pressure lower than the atmospheric pressure, i.e., air with negative pressure, is accumulated in the accumulator 12, and the negative pressure is utilized by the utilization device 13.

Figure 6:
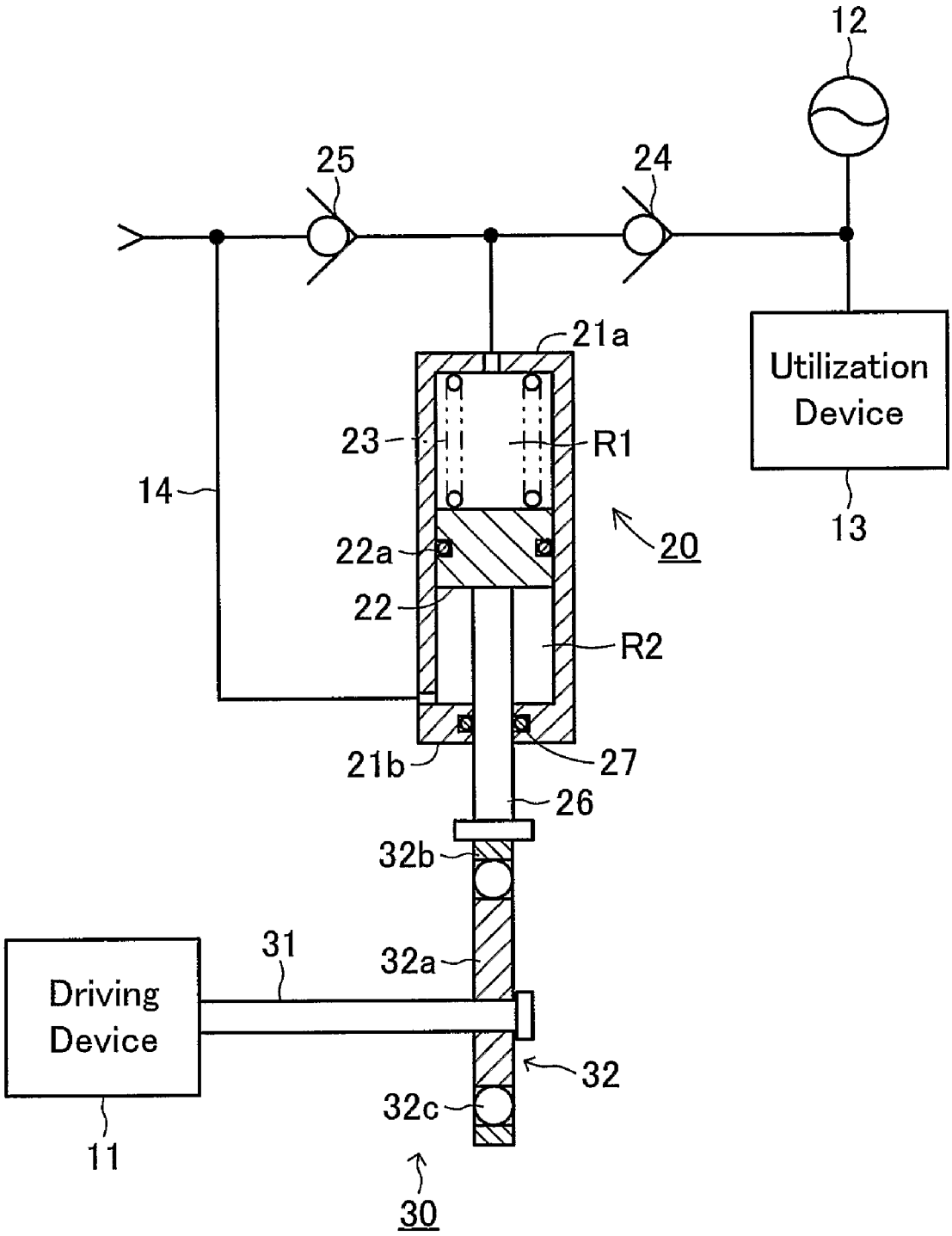
FIG. 6 is an overall schematic view showing a pressure accumulating apparatus according to a modified example in which negative pressure is utilized in the first embodiment.

FIG. 6 is an overall schematic view showing a pressure accumulating apparatus obtained by modifying the pressure accumulating apparatus according to the first embodiment for utilizing negative pressure. In this pressure accumulating apparatus, the accumulator 12 and the utilization device 13 are connected to the upstream side of the intake vale 24, and the downstream side of the discharge valve 25 and the second chamber R2 in the cylinder 21 communicate with atmospheric air. The other configuration is the same as that in the first embodiment.

According to this configuration, the air in the accumulator 12 is inspired into the first chamber R1 in the cylinder 21 via the intake valve 24 upon the descent of the piston 22. The air inspired into the first chamber R1 is discharged to the atmospheric air via the discharge valve 25 upon the rise of the piston 22. Accordingly, the air pressure in the accumulator 12 is decreased, i.e., becomes negative pressure, by the reciprocating movement of the piston 22. When the air pressure in the accumulator 12 becomes lower than the atmospheric air by a predetermined pressure, the air pressure in the first chamber R1 in the cylinder 21 also becomes lower than the atmospheric pressure by the predetermined pressure upon the start of the descent of the piston 22. The low-pressure air in the first chamber R1 acts as force for pulling up the piston 22 against the coil spring 23 due to the differential pressure between the air pressure in the second chamber R2 (atmospheric pressure) and the air pressure in the first chamber R1. Therefore, the piston 22 and the piston rod 26 are kept to be the uppermost position, so that the contact between the lower end face of the piston rod 26 and the ring 32*b* of the eccentric cam 32 is broken.

On the other hand, when the air pressure in the accumulator 12 increases due to the use of the negative pressure in the accumulator 12 by the utilization device 13, the piston 22 is urged in the downward direction by the coil spring 23 and starts to move up and down in a reciprocating manner by the eccentric cam 32. Thus, the air pressure in the accumulator 12 again falls down. The foregoing operation will be repeated after that. As a result, the effect same as that in the first embodiment is expected according to this modified example.

Figure 7:
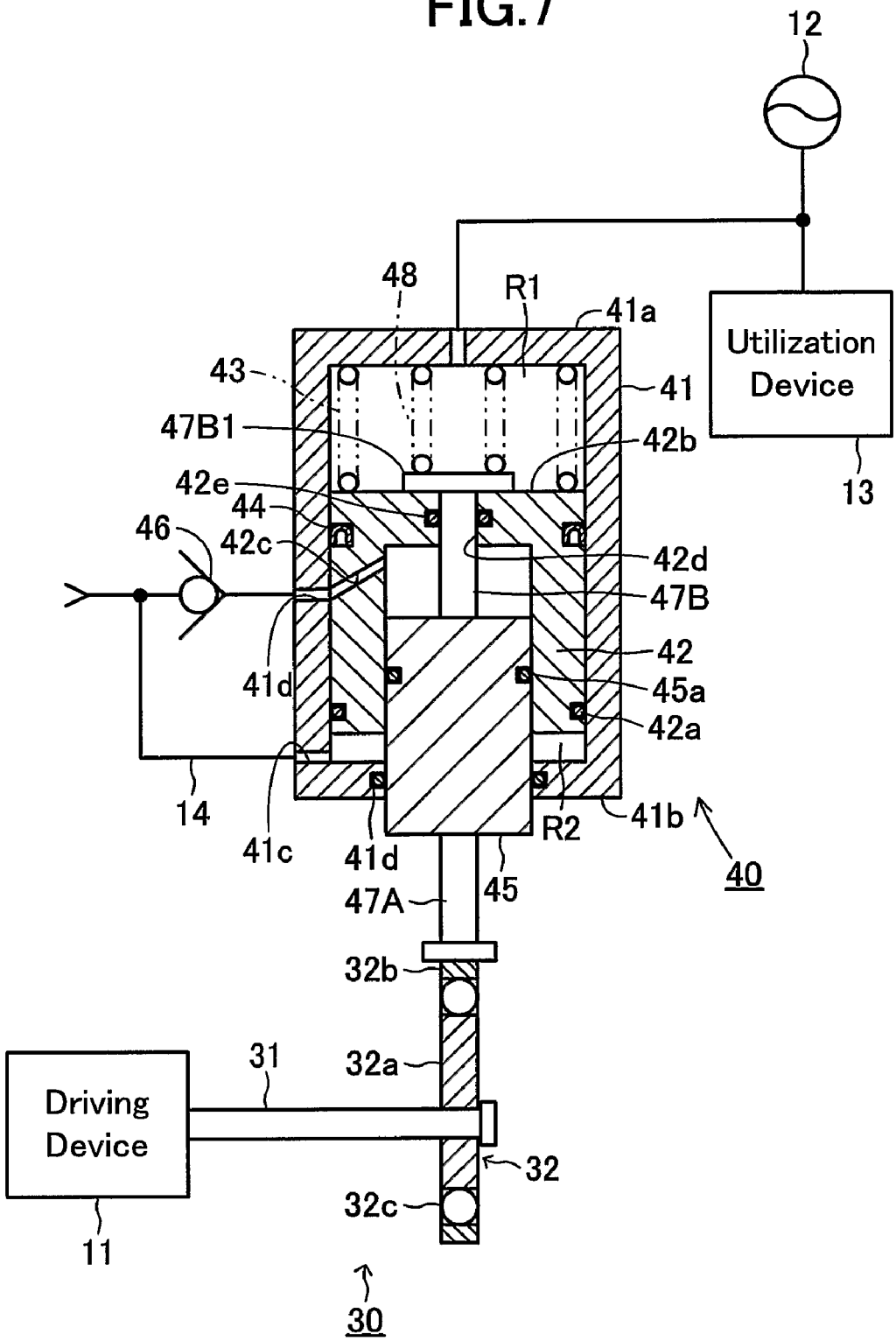
FIG. 7 is an overall schematic view showing a pressure accumulating apparatus according to a modified example in which negative pressure is utilized in the first modified example of the first embodiment.

FIG. 7 is an overall schematic view of a pressure accumulating apparatus obtained by modifying the pressure accumulating apparatus according to the first modified example of the first embodiment shown in FIG. 2, like the modified example shown in FIG. 6, such that negative pressure is accumulated in the accumulator 12 and the negative pressure is utilized by the utilization device 13. In this pressure accumulating apparatus, the accumulator 12 and the utilization device 13 communicate with the first chamber R1 in the cylinder 41, and the downstream side of the discharge valve 46 and the second chamber R2 in the cylinder 41 communicate with the atmospheric air. The other configuration is the same as that in the first modified example of the first embodiment.

In this modified example too, the air pressure in the accumulator 12 decreases, i.e., the air pressure in the accumulator 12 becomes negative, by the reciprocating movement of the piston 45, like the modified example shown in FIG. 6. In this case too, when the air pressure in the accumulator 12 becomes lower than the atmospheric pressure by a predetermined pressure, the air pressure in the first chamber R1 in the cylinder 41 becomes lower than the atmospheric pressure by a predetermined pressure upon the start of the descent of the piston 22. Accordingly, the first and second pistons 42 and 45 are pulled up against the coil springs 43 and 48. Therefore, the first and second pistons 42 and 45 and the piston rods 47A and 47B are kept to be the uppermost position, so that the contact between the lower end face of the piston rod 47A and the ring 32*b* of the eccentric cam 32 is broken.

On the other hand, when the air pressure in the accumulator 12 increases due to the use of the negative pressure in the accumulator 12 by the utilization device 13, the first and second pistons 42 and 45 are urged in the downward direction by the coil springs 43 and 48 and start to move up and down in a reciprocating manner by the eccentric cam 32. Thus, the air pressure in the accumulator 12 again falls down. As a result, the effect same as that in the first modified example of the first embodiment is expected according to this modified example.

Figure 3:
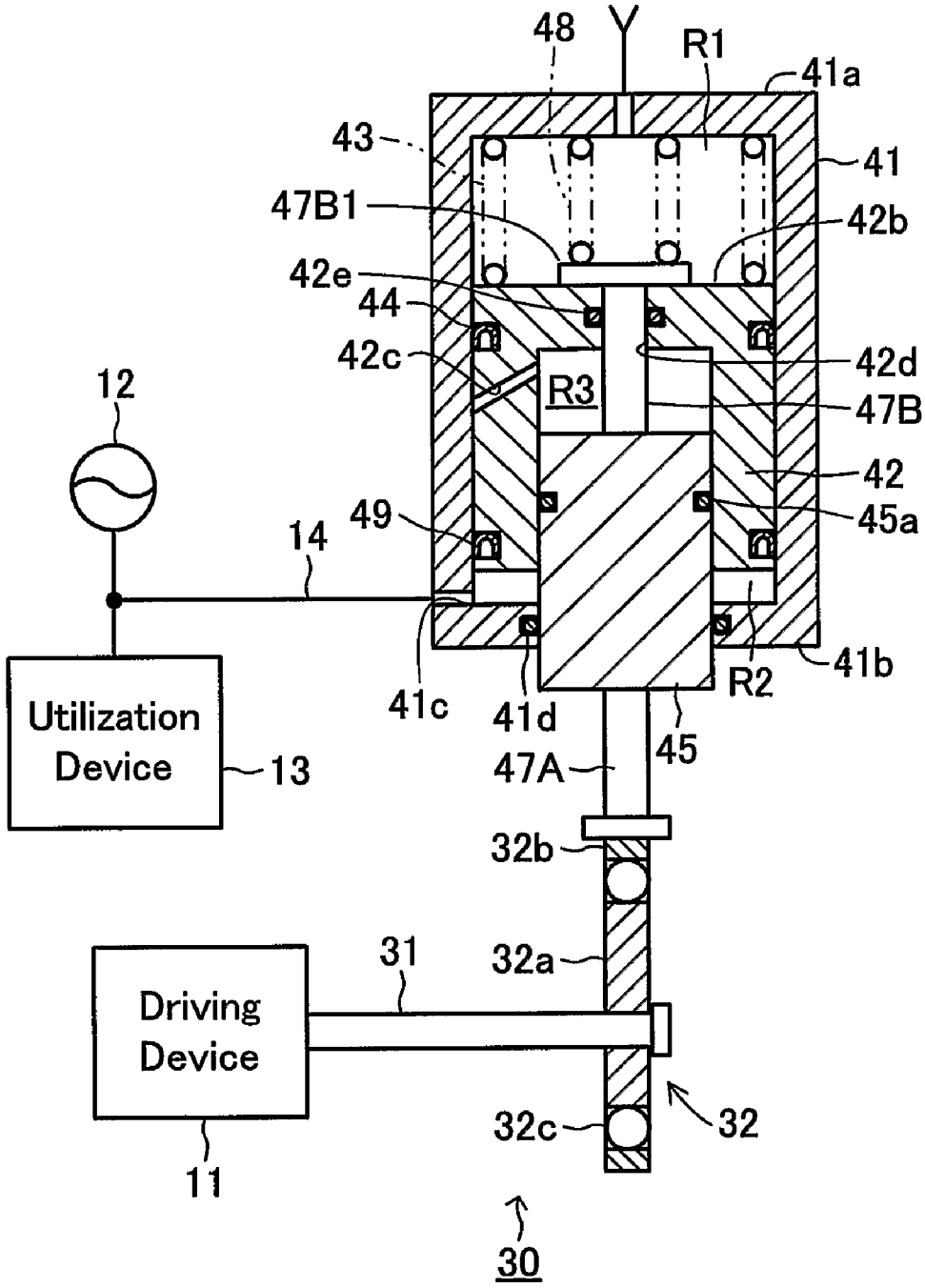
FIG. 3 is an overall schematic view showing a pressure accumulating apparatus according to a second modified example of the first embodiment.
Figure 8:
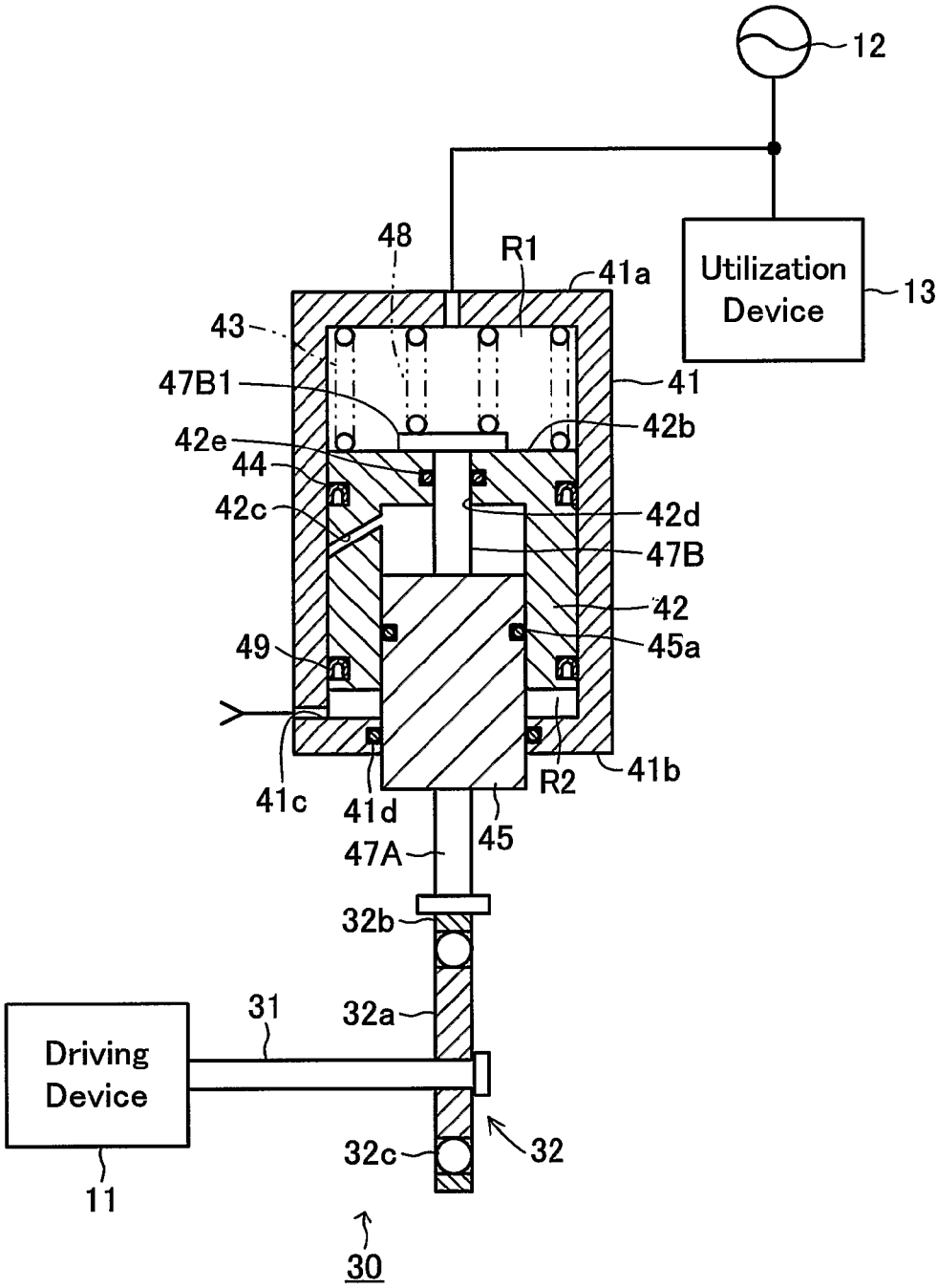
FIG. 8 is an overall schematic view showing a pressure accumulating apparatus according to a modified example in which negative pressure is utilized in the second modified example of the first embodiment.

FIG. 8 is an overall schematic view of a pressure accumulating apparatus obtained by modifying the pressure accumulating apparatus according to the second modified example of the first embodiment shown in FIG. 3, like the modified example shown in FIG. 7, such that negative pressure is accumulated in the accumulator 12 and the negative pressure is utilized by the utilization device 13. In this pressure accumulating apparatus, the accumulator 12 and the utilization device 13 communicate with the first chamber R1 in the cylinder 41, and second chamber R2 in the cylinder 41 communicates with the atmospheric air. The other configuration is the same as that in the second modified example of the first embodiment.

This modified example operates in the same manner as the modified example shown in FIG. 7, except for the action of the cup seal member 49, as explained in the second modified example of the first embodiment shown in FIG. 3. Accordingly, the effect same as that in the second modified example of the first embodiment is expected according to this modified example shown in FIG. 8.

Figure 4:
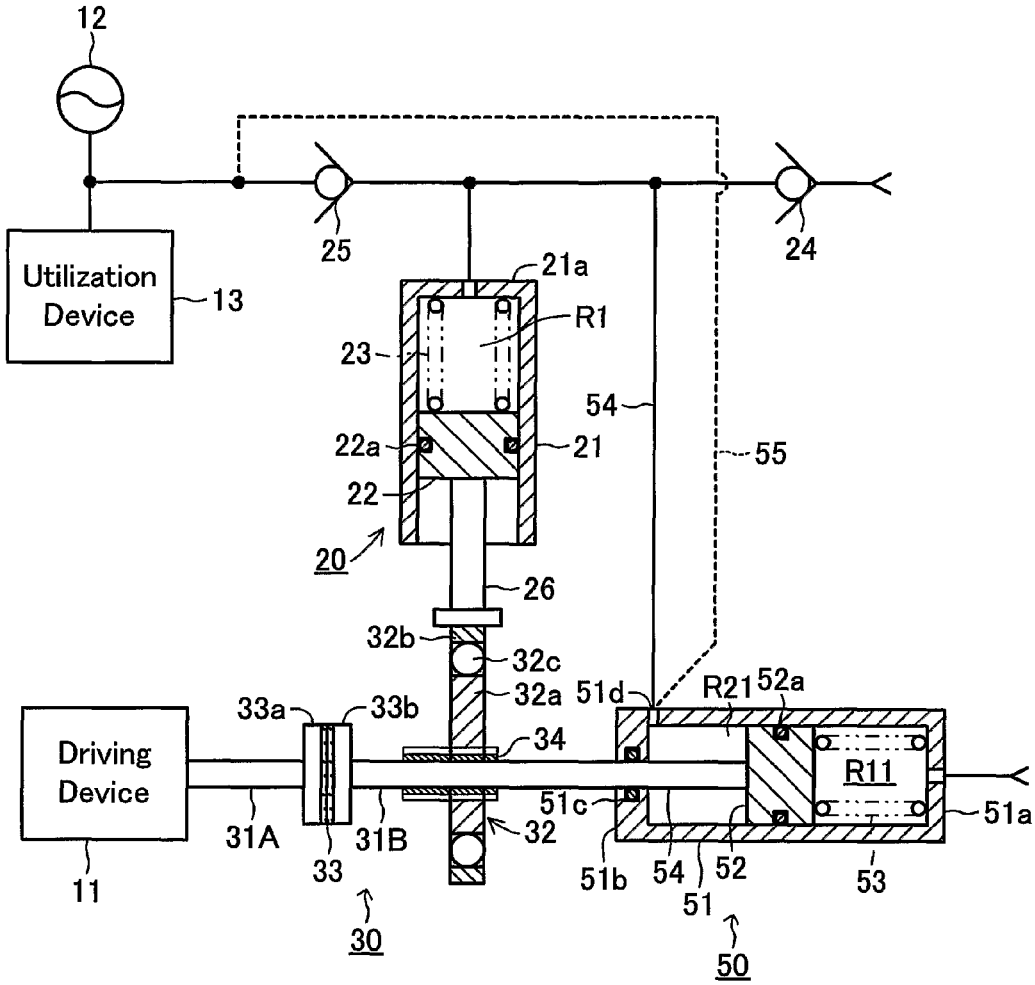
FIG. 4 is an overall schematic view showing a pressure accumulating apparatus according to a second embodiment of the present invention.
Figure 9:
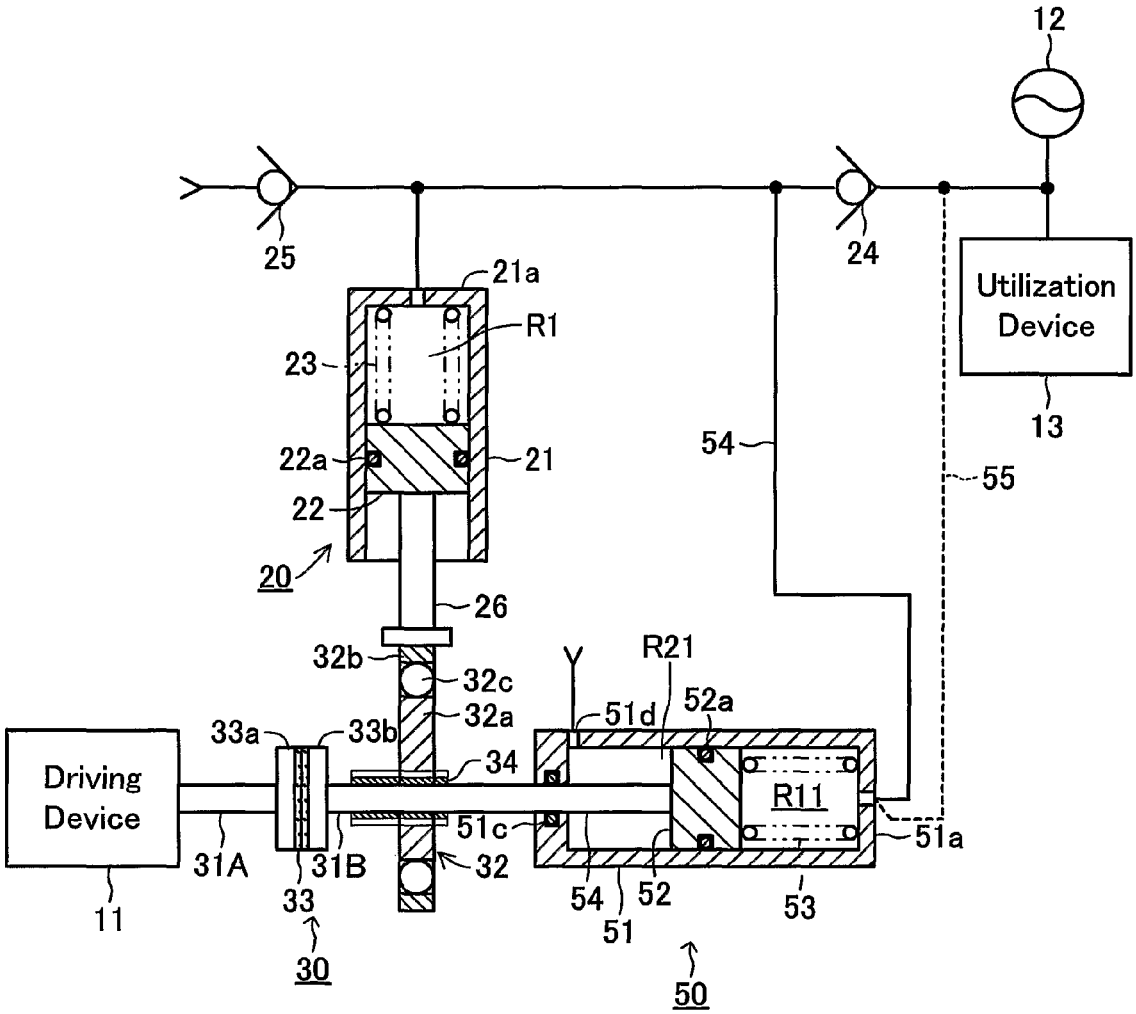
FIG. 9 is an overall schematic view showing a pressure accumulating apparatus according to a modified example in which negative pressure is utilized in the second embodiment.

FIG. 9 is an overall schematic view of a pressure accumulating apparatus obtained by modifying the pressure accumulating apparatus according to the second embodiment shown in FIG. 4, like the modified examples shown in FIGS. 6 to 8, such that negative pressure is accumulated in the accumulator 12 and the negative pressure is utilized by the utilization device 13. In this pressure accumulating apparatus, the accumulator 12 and the utilization device 13 communicate with the upstream side of the intake valve 24, and the downstream side of the discharge valve 25 communicates with the atmospheric air. The first chamber R11 in the cylinder 51 communicates with the first chamber R1 in the cylinder 21 (i.e., the downstream side of the intake valve 24) or the accumulator 12, while the second chamber R21 in the cylinder 51 communicates with the atmospheric air. The other configuration is the same as that in the second embodiment.

In this modified example too, the air pressure in the accumulator 12 decreases, i.e., the air pressure in the accumulator 12 becomes negative, by the reciprocating movement of the piston 22, like the modified examples shown in FIGS. 6 to 8. In this case too, when the air pressure in the accumulator 12 becomes lower than the atmospheric pressure by a predetermined pressure, the air pressure in the first chamber R1 in the cylinder 41 becomes lower than the atmospheric pressure by a predetermined pressure upon the start of the descent of the piston 22. Accordingly, the piston 52, piston rod 54 and rotating rod 31B are displaced in the rightward direction in the figure against the coil spring 53, which brings the clutch 33 into a disengaged state. Therefore, the rotational force transmitted from the driving device 11 to the rotating rod 31B via the rotating rod 31A is cut off, so that the operation of the pressure conversion mechanism 20 stops.

On the other hand, when the air pressure in the accumulator 12 increases due to the use of the negative pressure in the accumulator 12 by the utilization device 13, the piston 52, piston rod 54 and rotating rod 31B are urged in the leftward direction by the coil spring 53, so that the clutch is brought into an engaged state. Accordingly, the rotational force from the driving device 11 is again transmitted to the rotating rod 31B via the rotating rod 31A, whereby the operation of the pressure conversion mechanism 20 is restarted. Thus, the air pressure in the accumulator 12 starts to fall down again. As a result, the effect same as that in the second embodiment is expected according to the modified example.

Figure 5:
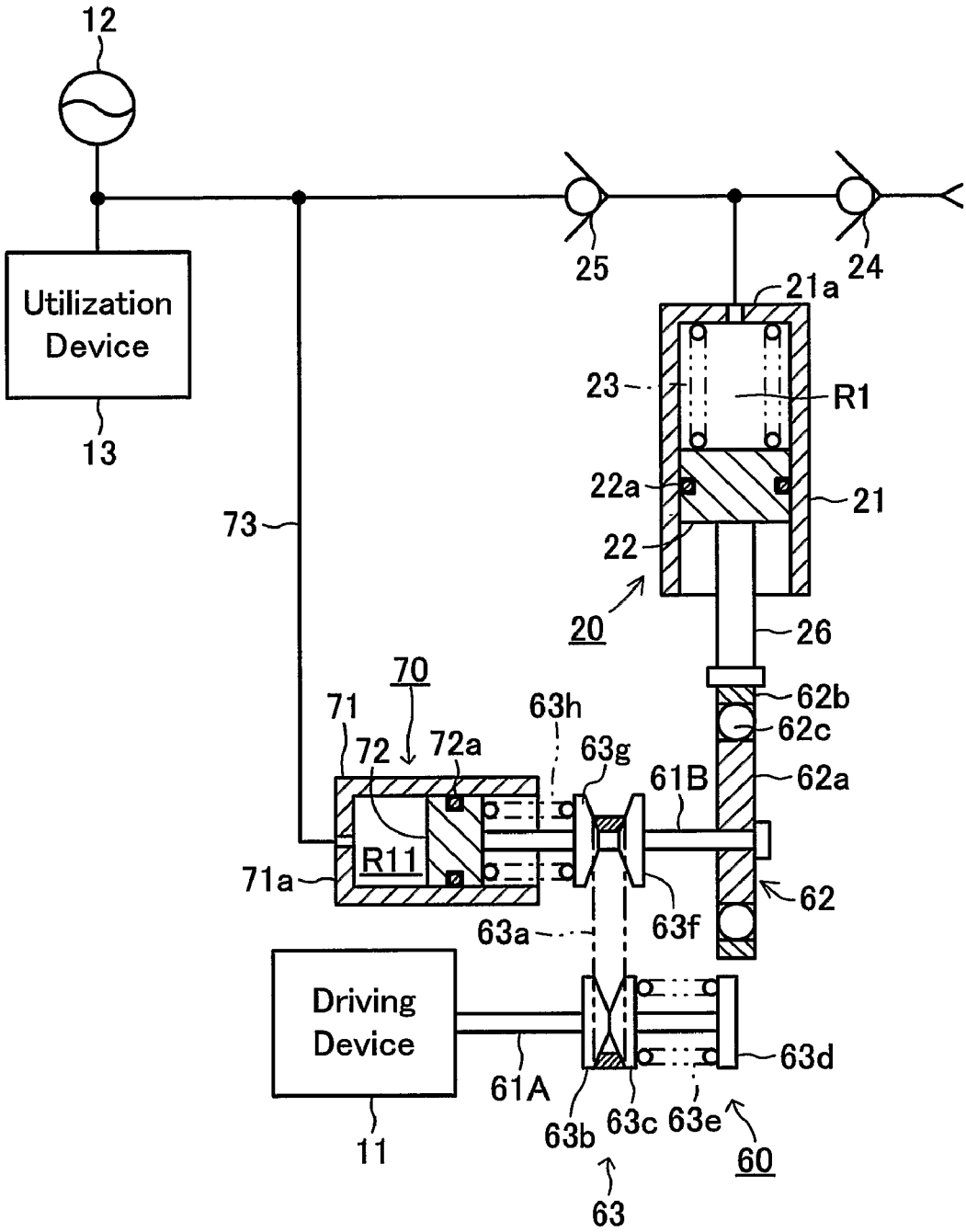
FIG. 5 is an overall schematic view showing a pressure accumulating apparatus according to a third embodiment of the present invention.
Figure 10:
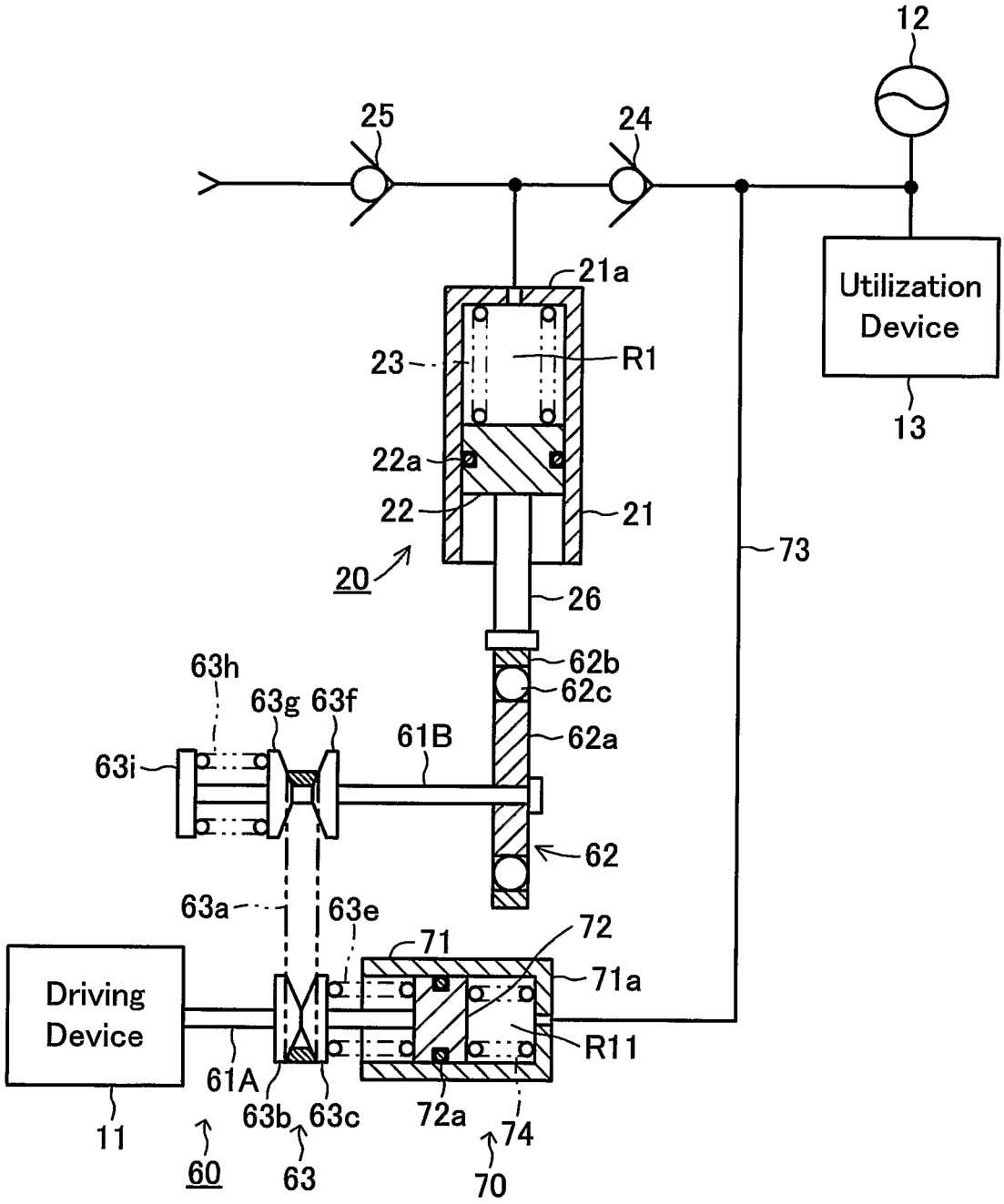
FIG. 10 is an overall schematic view showing a pressure accumulating apparatus according to a modified example in which negative pressure is utilized in the third embodiment.

FIG. 10 is an overall schematic view of a pressure accumulating apparatus obtained by modifying the pressure accumulating apparatus according to the third embodiment shown in FIG. 5, like the modified examples shown in FIGS. 6 to 9, such that negative pressure is accumulated in the accumulator 12 and the negative pressure is utilized by the utilization device 13. In this pressure accumulating apparatus, the accumulator 12 and the utilization device 13 communicate with the upstream side of the intake valve 24, and the downstream side of the discharge valve 25 communicates with the atmospheric air. In this modified example, the restricting mechanism 70 is attached to the side of the rotating rod 61A, and one end of the coil spring 63*h* in the power transmission mechanism 60 is supported by a stopper member 63*i* fixed to one end of the rotating rod 61B. The piston 72 in the restricting mechanism 70 is connected to the rotating rod 61A, and the piston 72 supports the coil spring 63*e*. In this case, the first chamber R11 in the cylinder 71 communicates with the accumulator 12 and the upstream side of the intake valve 24 via the air path 73. A coil spring 74 is accommodated in the first chamber R11 for urging the piston 72 in the leftward direction in the figure.

In this modified example, the rotational force from the driving device 11 is transmitted to the eccentric cam 32 via the continuously variable transmission mechanism 63, whereby the air pressure in the accumulator 12 decreases, i.e., becomes negative, by the reciprocating movement of the piston 22, like the modified examples shown in FIGS. 6 to 8. During the process of accumulating negative pressure in the accumulator 12, the air pressure in the first chamber R11 in the cylinder 71 is also kept to be high via the air path 73 with the state in which the air pressure in the accumulator 12 is high. In this case, the urging force of the coil spring 74 overcomes the suction force by the coil spring 63*e* and the air pressure in the first chamber R11, so that the piston 72 is located at the left side in the cylinder 71 in the figure. In this state, the space between the fixed sheave 63*b* and the movable sheave 63*c* is narrow, i.e., the rotational radius of the belt 63*a* at the first variable pulley is set great. On the contrary, the space between the fixed sheave 63*g* and the movable sheave 63*f* is great, i.e., the rotational radius of the belt 63*a* at the second variable pulley is small. With this state, the ratio of the revolution of the rotating rod 61B to the revolution of the rotating rod 61A driven by the driving device 11 is great, so that the rotating plate 62*a* of the eccentric cam 62 rotates with high speed. Accordingly, with this state, the eccentric cam 62 causes the piston rod 26 and the piston 22 to move up and down in a reciprocating manner with high speed, whereby the conversion output of the pressure conversion mechanism 20 is great.

On the other hand, when the air pressure in the accumulator 12 falls down, the coil spring 63*e* and the suction force by the air pressure in the first chamber R1 displaces the piston 72 in the rightward direction in the figure against the urging force of the coil spring 74. The displacement of the piston 72 in the rightward direction displaces the movable sheave 63*c* in the rightward direction in the figure. Accordingly, the space between the fixed sheave 63*b* and the movable sheave 63*c* increases, i.e., the rotational radius of the belt 63*a* at the first variable pulley is set small, as the air pressure in the accumulator 12 falls down. On the contrary, the space between the fixed sheave 63*g* and the movable sheave 63*f* decreases, i.e., the rotational radius of the belt 63*a* at the second variable pulley increases. As a result, the ratio of the revolution of the rotating rod 61B to the revolution of the rotating rod 61A driven by the driving device 11 decreases as the air pressure in the accumulator 12 falls down, so that the revolution speed of the rotating plate 62*a* of the eccentric cam 62 is slowed down. Accordingly, with this state, the eccentric cam 62 causes the piston rod 26 and the piston 22 to move up and down in a reciprocating manner with low speed, whereby the conversion output of the pressure conversion mechanism 20 reduces. As a result, the effect same as that in the third embodiment is expected according to this modified example.

The present invention is not limited to the first, second and third embodiments and their modified examples. Various modifications are possible within the scope of the present invention.

For example, although each of the aforesaid embodiments and modified examples describe the case of using air as a fluid, the present invention can be applied to a fluid pressure accumulating apparatus using gas other than air, or liquid such as oil. In case where liquid is used as a fluid, each of the seal members in the above-mentioned explanation is utilized for keeping the liquid-tightness between members at both sides of the seal member. Further, the pressure accumulating apparatus according to the present invention can of course be applied to an apparatus for a vehicle other than a brake apparatus, and to an apparatus other than a vehicle.

The invention claimed is:

1. A pressure accumulating apparatus provided with:

a power source that generates power;

a cylinder;

a first cylindrical piston with a bottom that is accommodated in the cylinder in an airtight or liquid-tight and slidable manner and has one end closed and the other end opened in the axial direction;

a second piston that slidably enters into the first cylindrical piston from the open end in an airtight or liquid-tight and slidable manner for forming a first chamber in the first cylindrical piston at the side of its closed end and forming a second chamber in the cylinder at the side of the open end of the first cylindrical piston;

a piston rod that is connected to the second piston for causing the second piston to move in a reciprocating manner in the cylinder and in the first cylindrical piston in the axial direction by its reciprocating movement in the axial direction;

a restricting rod that is connected to the second piston and projects from the closed end of the first cylindrical piston, the restricting rod allowing the reciprocating movement of the second piston to the first cylindrical piston within the predetermined range and displacing integral with the first cylindrical piston due to the engagement with the first cylindrical piston for restricting the displacement of the second piston to the first cylindrical piston outside the predetermined range;

an intake valve that is connected to the first chamber for inspiring low-pressure fluid into the first chamber when the second piston is displaced toward the open end of the first cylindrical piston;

a discharge valve that is connected to the first chamber for discharging the high-pressure fluid in the first chamber when the second piston is displaced toward the closed end of the first cylindrical piston;

pressure accumulating means that accumulates the high-pressure fluid discharged by the discharge valve;

power transmission means that causes the piston rod to move in a reciprocating manner in the axial direction with a predetermined range in accordance with the power from the power source; and the restricting means that cuts off the transmission of the power from the power source to the piston rod by the power transmission means, the restricting means being configured to direct the high-pressure fluid at the downstream side of the discharge valve into the second chamber and to urge the first cylindrical piston toward its closed end when the fluid pressure at the downstream side of the discharge valve becomes higher than the fluid pressure at the upstream side of the intake valve by a predetermined pressure.

2. A pressure accumulating apparatus according to claim 1, wherein the intake valve is composed of a one-way valve disposed between the cylinder and the first cylindrical piston.

3. A pressure accumulating apparatus according to claim 1, wherein the discharge valve is composed of a one-way valve disposed in a communication path from the first chamber to the second chamber and between the cylinder and the first cylindrical piston.

* * * * *